US008147039B2

(12) United States Patent
Kurokawa et al.

(10) Patent No.: US 8,147,039 B2
(45) Date of Patent: Apr. 3, 2012

(54) HEAD SUBSTRATE, PRINTHEAD, HEAD CARTRIDGE, AND PRINTING APPARATUS

(75) Inventors: Tomoko Kurokawa, Kawasaki (JP); Nobuyuki Hirayama, Fujisawa (JP); Masataka Sakurai, Kawasaki (JP); Ryo Kasai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 634 days.

(21) Appl. No.: 12/340,158

(22) Filed: Dec. 19, 2008

(65) Prior Publication Data

US 2009/0174753 A1 Jul. 9, 2009

(30) Foreign Application Priority Data

Jan. 9, 2008 (JP) ..... 2008-002611

(51) Int. Cl.
*B41J 2/05* (2006.01)

(52) U.S. Cl. ..... 347/56

(58) Field of Classification Search ..... 347/56, 347/50, 54, 57–59, 40, 42, 44, 46, 10, 12, 347/13, 19, 5, 9
See application file for complete search history.

(56) References Cited

U.S. PATENT DOCUMENTS

| | | | |
|---|---|---|---|
| 6,290,334 | B1 | 9/2001 | Ishinaga et al. |
| 6,474,789 | B1 | 11/2002 | Ishinaga et al. |
| 6,824,237 | B2 | 11/2004 | Hirayama et al. |
| 6,945,622 | B2 | 9/2005 | Sakurai |
| 7,321,444 | B2 | 1/2008 | Hirayama |
| 7,354,125 | B2 | 4/2008 | Hirayama et al. |
| 7,445,316 | B2 | 11/2008 | Hirayama |
| 2006/0284909 | A1 | 12/2006 | Kasai et al. |
| 2008/0129791 | A1 | 6/2008 | Furukawa et al. |

FOREIGN PATENT DOCUMENTS

| | | |
|---|---|---|
| JP | 5-185594 | 7/1993 |

*Primary Examiner* — Kristal Feggins
(74) *Attorney, Agent, or Firm* — Fitzpatrick, Cella, Harper & Scinto

(57) ABSTRACT

A head substrate is capable of integrating driver transistors while keeping the size small even at high nozzle density, while integrating a functional circuit such as a temperature sensor or energy adjustment circuit. An ink supply port, a heater array which is arrayed along the longitudinal direction of the ink supply port and includes a plurality of heaters, a transistor array which is arrayed along the arrayed direction of the heater array and includes a plurality of transistors for driving a plurality of heaters, and a logic circuit which drives the transistor array are arranged on the head substrate. The logic circuit is arranged between the heater array and the transistor array.

8 Claims, 15 Drawing Sheets

HEAD SUBSTRATE, PRINTHEAD, HEAD CARTRIDGE, AND PRINTING APPARATUS

BACKGROUND OF THE INVENTION

1. Field of the Invention

The present invention relates to a head substrate, printhead, head cartridge, and printing apparatus. Particularly, the present invention relates to a head substrate on which electrothermal transducers serving as heaters for generating heat energy necessary to print, and driving circuits for driving the electrothermal transducers are formed on a single substrate, a printhead using the head substrate, a head cartridge using the printhead, and a printing apparatus.

2. Description of the Related Art

Electrothermal transducers (heaters) and their driving circuits on a printhead mounted in a conventional inkjet printing apparatus are formed on a single substrate using a semiconductor process, as disclosed in, for example, Japanese Patent Laid-Open No. 5-185594. The "driving circuit" generically means a logic circuit, driver transistor, and the like for driving a heater. There has already been proposed a substrate of an arrangement in which an ink supply port for supplying ink is formed in the substrate and heaters are arrayed near the ink supply port to face each other.

FIG. 9 is a block diagram showing an example of the schematic layout of a head substrate used in a conventional inkjet printhead (to be referred to as a printhead hereinafter).

Referring to FIG. 9, a substrate 100 integrates heaters and their driving circuits by a semiconductor process. An ink supply port 101 supplies ink from the lower surface of the substrate. A heater array 102 includes a plurality of heaters. A driver transistor array 103 includes a plurality of driver transistors for supplying a desired current to heaters. A logic circuit 104*a* forms part of a driving circuit for generating a signal for selectively driving a driver transistor of the driver transistor array 103 for each desired heater block. A connection terminal 105 receives a power supply voltage and electrical signal from outside the substrate and outputs them to outside the substrate.

FIG. 10 is an equivalent circuit diagram of one segment for supplying a current to a heater in order to discharge ink.

Referring to FIG. 10, an AND circuit 701 calculates the logical product between a block selection signal sent from a decoder to select a block of heaters divided into desirable numbers of blocks, and a print data signal output from a shift register via a latch circuit. A level conversion circuit (LVC) 702 converts the amplitude voltage of an output pulse from the AND circuit 701 into a voltage for driving the gate of a driver transistor. A VDD power supply line 703 serves as the power supply of the logic circuit. A VHT power supply line 704 supplies the gate voltage of a driver transistor. A VH power supply line 705 serves as a power supply for driving a heater. A driver transistor 707 supplies a current to a heater 706. A GNDH line 708 receives a current flowing through the heater.

FIG. 11 is a block diagram for explaining a series of operations until the heater is driven after inputting a logic signal such as print data to the head substrate. In FIG. 11, the signal flow is schematically indicated by arrows. FIG. 11 shows a circuit block corresponding to one ink supply port.

In FIG. 11, the same reference numerals as those shown in FIG. 9 denote the same parts, and a description thereof will not be repeated.

An input circuit 104*c* includes a buffer circuit for inputting a logic signal to a logic circuit (to be described later) such as a shift register or decoder. A logic circuit 104*b* includes a shift register and latch circuit for temporarily storing externally input print data, and a decoder for outputting a block selection signal for selecting a plurality of heaters divided into desired numbers of blocks. The logic circuit 104*b* is arranged at the end of the head substrate. A logic circuit 104*a* includes at least an AND circuit which calculates the logical product between a block selection signal sent from a decoder and a print data signal output from a shift register via a latch circuit, and a voltage conversion circuit.

As is apparent from FIG. 11, the heater arrays 102 are arranged on the two sides of the ink supply port 101. The driver transistor array 103 is arranged along each heater array 102, and the logic circuit 104*a* is arranged along each driver transistor array 103.

When print data is input to the shift register via the input terminal 105, the shift register temporarily stores the print data, and the latch circuit outputs the print data signal. Then, a block selection signal for selecting a block of heaters divided into desired numbers of blocks, and a print data signal are ANDed. A current flows through a heater in synchronism with a heat enable signal HE which determines the current driving time. The series of operations is repeated for respective blocks to execute printing.

FIG. 12 is a plan view showing the layout of the head substrate shown in FIG. 9.

In FIG. 12, the same reference numerals as those shown in FIG. 9 denote the same parts.

As shown in FIG. 12, each driver transistor 103*a* of the driver transistor array 103 is a MOSFET corresponding to one heater 102*a*.

A drain electrode D 103*b* of the MOSFET is series-connected to the heater 102*a*. The MOSFET has a gate electrode 103*c* and source electrode S 103*d*. In this layout, the heater 102*a* is adjacent to the driver transistor 103*a*, and the heater pitch and driver transistor pitch are equal to each other.

The term "pitch" is defined as a distance (interval) between a center of one constituent element and that of its adjacent constituent element in an arrayed direction of the constituent elements. In FIG. 12, an "X" axis indicates an arrayed direction of heaters and driver transistors. Thus, with respect to the arrayed direction "X", the "pitch" of heaters indicates a distance (interval) A between the center of the heater 102*a* and that of its adjacent heater. As shown in FIG. 12, the center of the heater 102*a* means that the length indicated by an arrow a is equal to that indicated by another arrow a'. Likewise, with respect to the arrayed direction "X", the distance (interval) between the center of the driver transistor 103*a* and that of its adjacent driver transistor is "B". As shown in FIG. 12, the center of the driver transistor 103*a* means that the length indicated by an arrow b is equal to that indicated by another arrow b'. Note that the pitch A of the heater 102*a* is equal to the pitch B of the driver transistor 103*a* in the example of FIG. 12.

Recent inkjet printing apparatuses (to be referred to as printing apparatuses hereinafter) are increasing the arrangement density of printhead nozzles in order to achieve high-speed, high-quality printing. As a method of manufacturing nozzles at high precision has been developed, a nozzle pitch of about 600 dpi in actual size has been achieved.

In accordance with this nozzle pitch, heaters and driver transistors for driving them are formed on a silicon substrate. For example, for nozzles at a resolution of 600 dpi, heaters and driver transistors are arranged at approximately the same 600-dpi resolution. The driver transistor is often formed from a MOS transistor which controls a current flowing through the source-drain path by the gate application voltage. When arranging MOS transistors at the 600-dpi resolution, the gates of MOS transistors are arranged at high density regardless of the nozzle pitch, and then a plurality of MOS transistors are parallel-connected in accordance with the nozzle pitch, in order to implement an efficient arrangement. More specifically, as shown in FIG. 13, the printing apparatus adopts a circuit arrangement in which heaters at 600 dpi are driven using MOS transistors connected by juxtaposing, for example, four (4) gate electrodes.

FIG. 13 is a plan view showing part of the layout of a head substrate having a nozzle resolution of 600 dpi. In FIG. 13, the same reference numerals as those described above denote the same parts, and a description thereof will not be repeated. Reference numeral 103A denotes a driver transistor arrangement region; 107, a power supply line.

The driver transistors need to have a gate width W capable of supplying a current enough for ink discharge to the heater 102*a*.

More specifically, it is necessary that the MOS transistor operates in a linear region upon supplying a heater current, and the ON resistance at this time is much lower than the heater resistance. For example, for conventional MOS transistors arranged at the 600-dpi pitch, four gates are arranged for one nozzle, so transistors having a relatively large gate width W can be formed. That is, a gate width W larger by four times than the width of the physical driver transistor arrangement region 103A can be implemented.

In the current printhead arrangement, the power supply line 107 for applying a power supply voltage to a heater is arranged on an upper layer above the transistor arrangement region. The power supply line needs to ensure a predetermined wiring width or more under the restriction on the parasitic resistance. In the conventional arrangement having a nozzle pitch of about 600 dpi, the wiring width is often larger than the originally required gate width W of one of juxtaposed transistors. Hence, the gate width of the driver transistor can be designed with a margin.

The method of manufacturing nozzles at high precision is being improved, and a higher density can be expected. For example, in an arrangement in which the nozzle density increases to about 1,200 dpi which is double 600 dpi, the number of juxtaposed gates of transistors per nozzle decreases from four to two, compared to the conventional arrangement with 600-dpi pitch.

FIG. 14 is a plan view showing part of the layout of a head substrate having a nozzle pitch of 1,200 dpi. Also in FIG. 14, the same reference numerals as those described above denote the same parts, and a description thereof will not be repeated. Reference numeral 103B denotes a driver transistor arrangement region.

When coping with high-density nozzles at a pitch of 1,200 dpi, the number of gate electrodes 103*c* which can be juxtaposed per nozzle is two. For this reason, only transistors having half the gate width W of the conventional 600-dpi (4-gate) arrangement can be formed. Only a region defined by power supply wiring cannot provide a necessary transistor gate width in the conventional 600-dpi arrangement, and transistors sometimes need to be arranged in a region exceeding the power supply wiring region. When arranging transistors in a region exceeding the power supply wiring region, it is required in terms of even cost to suppress the gate width W of the transistor as much as possible and downsize the head substrate.

As described above, as the nozzle density increases, it becomes difficult to design the gate width of the driver transistor integrated in the head substrate with a margin for characteristics. In a head substrate using driver transistors with little margin for the gate width, the design must pay attention to a change of the characteristics of the driver transistors. Particularly, in a printhead using a heater for a printing element, bubbling by heat generated by the heater is used to discharge an ink droplet, so heat of the heater greatly changes. The driver transistor is arranged near the heater, and the characteristics of the driver transistor are influenced by heat of the heater.

As examined above, driver transistors integrated in a conventional head substrate having a nozzle density of about 600 dpi (four gates) ensure a sufficiently large gate width, so the influence of heat is not particularly recognized as an important issue. However, to cope with higher nozzle density, a heat-tolerant head substrate needs to be designed. To reduce the influence of heat, the gate width W of driver transistors may be increased. However, this method increases the chip size on a head substrate having a nozzle density of 1,200 dpi, and raises the cost.

On the head substrate, a sensor for monitoring the temperature of the head substrate, an energy adjustment circuit for achieving stable driving, an electrode for an external electrical connection, and the like sometimes need to be arranged. In addition, recent printing apparatuses must increase the number of nozzles and prolong the nozzle array in order to increase the print speed. Therefore, the size of the head substrate increases in the nozzle array direction. If the head substrate size is large in the nozzle array direction, a relatively large temperature distribution tends to be generated in the nozzle array direction upon the print operation.

In a printhead using a head substrate which integrates heaters, it is particularly important to detect the substrate temperature because the ink discharge characteristic greatly changes depending on the substrate temperature.

In conventional temperature detection, a diode is arranged at the end of a head substrate or the like to obtain a temperature from the forward voltage. Alternatively, wiring is laid out in the nozzle array direction to obtain a temperature from a change of the resistance. When the diode is arranged at the end of the head substrate, the temperature of a local region where the diode is arranged is detected. When wiring is laid out in the nozzle array direction to obtain a temperature from a change of the resistance, the average temperature of the wiring is detected.

However, in a head substrate long in the nozzle array direction, the temperature distribution in the nozzle array direction is desirably measured to perform higher-precision driving control. If dedicated temperature sensors are arranged in the nozzle array direction to measure the temperature distribution in the nozzle array direction, such arrangement increases the head substrate size.

In the first place, the heater pitch and driver transistor pitch need not be aligned to each other, and the driver transistor can take a different pitch. However, if the heater pitch and driver transistor pitch are different from each other, the heater and driver transistor need to be connected by stepwise wiring or diagonal wiring. The wiring has layout rules such as the thickness and the interval between adjacent wires. For diagonal wiring, the interval between the heater and the driver must be widened, increasing the head substrate size. To prevent the increase in head substrate size caused by diagonal wiring, the heater pitch and driver transistor pitch must be aligned to some extent. For example, even if the driver transistor pitch can be set smaller than the heater pitch, the driver transistor pitch is set unnecessarily large. Neither a space which is generated if the driver transistor pitch is decreased can be ensured, nor can a functional circuit be arranged, resulting in an inefficient layout.

If the nozzle array becomes long, variations in heaters in the nozzle array direction, variations in discharge characteristic, or variations in the parasitic wire resistance from the power supply terminal to the heater become serious.

To correct such variations in the nozzle array direction, an energy adjustment circuit may also be arranged for each heater group in the nozzle array direction. When the energy adjustment circuit is arranged at the end of a head substrate, the scale of a circuit arranged at the end of the head substrate increases as the number of nozzles (the number of heaters) increases, resulting in a large head substrate size. The circuit arranged at the end of the head substrate and the heater need to be connected by wiring. As the number of heater groups increases, the number of wires increases. To ensure the wiring region, the head substrate size increases. To suppress the increases in the wiring region and the number of wires at the end of the head substrate, the energy adjustment circuit is desirably arranged in the nozzle array direction. Even in this case, the head substrate size increases in the conventional circuit arrangement.

As described above, when the temperature sensor, energy adjustment circuit, or the like is arranged in the nozzle array direction in a head substrate long in the nozzle array direction, the substrate size increases.

SUMMARY OF THE INVENTION

Accordingly, the present invention is conceived as a response to the above-described disadvantages of the conventional arrangement.

For example, a head substrate according to this invention is capable of integrating driver transistors while keeping the size small even at high nozzle density, and integrating a functional circuit such as a temperature sensor or energy adjustment circuit. The head substrate is used in a printhead or head cartridge, and the printhead or head cartridge is used in a printing apparatus.

According to one aspect of the present invention, preferably, there is provided a head substrate comprising: an ink supply port; a heater array which is arrayed along a longitudinal direction of the ink supply port and includes a plurality of heaters; a transistor array which is arrayed along an arrayed direction of the heater array and includes a plurality of transistors for driving the plurality of heaters; and a logic circuit which drives the transistor array, wherein the logic circuit is arranged between the heater array and the transistor array.

According to another aspect of the present invention, preferably, there is provided a printhead using the above head substrate.

According to still another aspect of the present invention, preferably, there is provided a head cartridge integrating the above printhead and an ink tank containing ink to be supplied to the printhead.

According to still another aspect of the present invention, preferably, there is provided a printing apparatus to which the above printhead or head cartridge is mounted.

The invention is particularly advantageous since an ink supply port, heater array, logic circuit, and transistor array are arranged on a head substrate in an order named. More specifically, this arrangement increases the distance between the transistor array which may influence the ink discharge characteristic under the influence of heat of the heater, and the heater array, reducing the influence of heat of the heater on the transistor.

In the head substrate layout design, for example, the influence of heat of the heater on the discharge characteristic of the transistor can be suppressed.

The logic circuit is arranged between the transistor array and the heater array to increase the distance between them, enabling diagonal wiring without any restriction on the wiring rule. This arrangement can obviate the need to align the transistor pitch and heater pitch, increasing the layout efficiency.

In addition, when the interval between transistors has a margin, even though the transistor pitch can be set smaller than the heater pitch, it is still possible to form an empty space in the arrayed direction of the transistor array. For example, a temperature sensor, energy adjustment circuit, electrode, or the like is arranged in the empty space, implementing an advanced head substrate without increasing the head substrate size.

Further features of the present invention will become apparent from the following description of exemplary embodiments with reference to the attached drawings.

DESCRIPTION OF THE EMBODIMENTS

Figure 1:
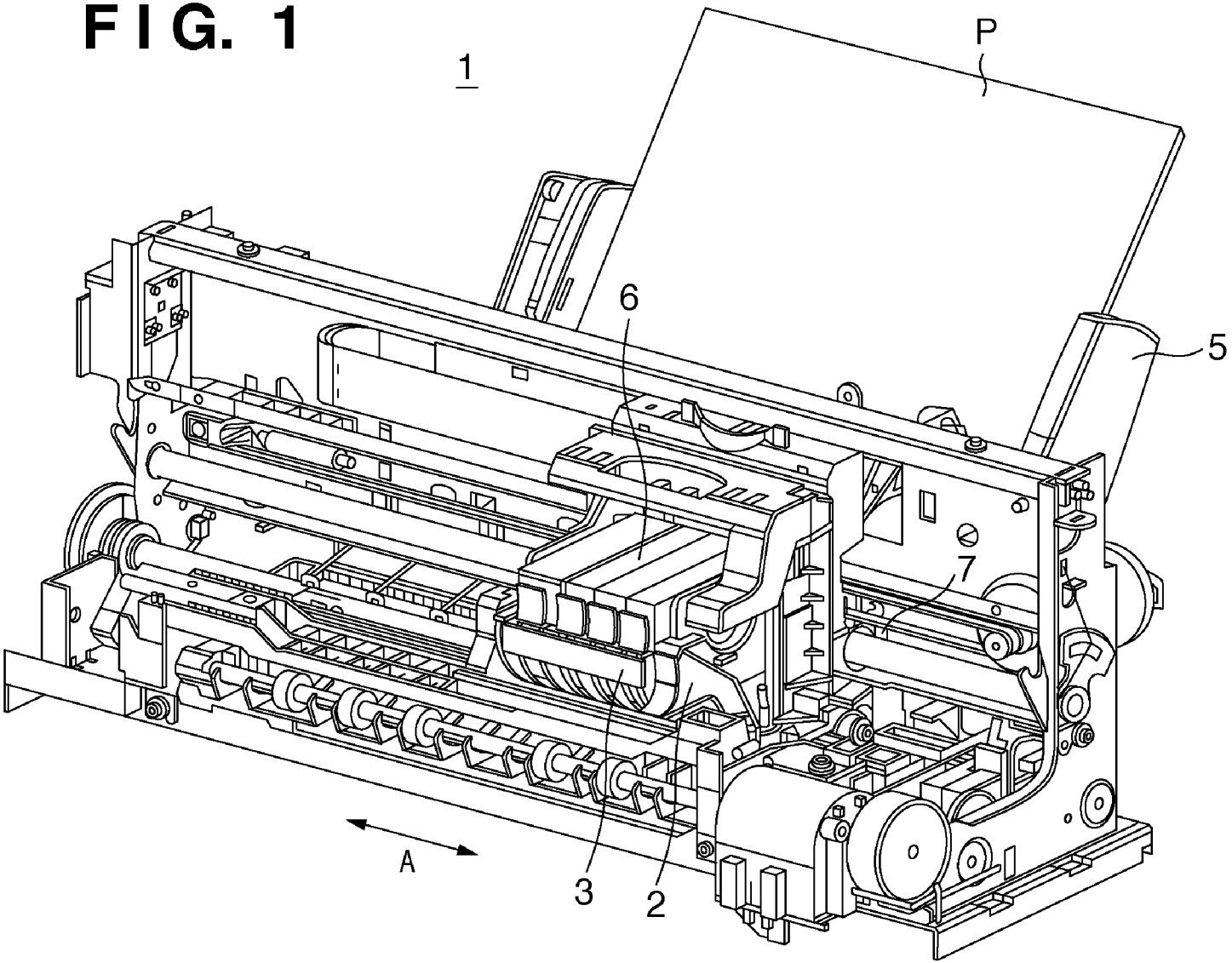
FIG. 1 is a schematic perspective view showing the outer appearance of the structure of an inkjet printing apparatus as a typical embodiment of the present invention.

Preferred embodiments of the present invention will now be described in detail in accordance with the accompanying drawings. The same reference numerals as those described above denote the same parts, and a repetitive description thereof will be omitted.

In this specification, the terms “print” and “printing” not only include the formation of significant information such as characters and graphics, but also broadly include the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Furthermore, unless otherwise stated, the term "printing element" generally means a set of a discharge orifice, a liquid channel connected to the orifice and an element to generate energy utilized for ink discharge.

A head substrate in the description not only includes a simple substrate made of a silicon semiconductor, but also broadly includes an arrangement having elements, wires, and the like.

The expression "on a substrate" not only includes "on an element substrate", but also broadly includes "on the surface of an element substrate" and "inside of an element substrate near its surface". The term "built-in" in the invention not only includes "simply arrange separate elements on a substrate", but also broadly includes "integrally form and manufacture elements on an element substrate by a semiconductor circuit manufacturing process or the like".

<Description of Inkjet Printing Apparatus (FIG. 1)>

FIG. 1 is a schematic perspective view showing the outer appearance of the structure of an inkjet printing apparatus 1 as a typical embodiment of the present invention.

In the inkjet printing apparatus (to be referred to as a printing apparatus hereinafter), as shown in FIG. 1, a carriage 2 supports a printhead 3 which prints by discharging ink according to the inkjet method. The carriage 2 reciprocates in directions indicated by an arrow A to print. A print medium P such as print paper is fed via a paper feed mechanism 5 and conveyed to a print position. At the print position, the printhead 3 prints by discharging ink to the print medium P.

The carriage 2 of the printing apparatus 1 supports not only the printhead 3, but also an ink cartridge 6 which contains ink to be supplied to the printhead 3. The ink cartridge 6 is detachable from the carriage 2.

The printing apparatus 1 shown in FIG. 1 can print in color. For this purpose, the carriage 2 supports four ink cartridges which respectively contain magenta (M), cyan (C), yellow (Y), and black (K) inks. The four ink cartridges are independently detachable.

The printhead 3 according to the embodiment employs an inkjet method of discharging ink by using heat energy, and thus has an electrothermal transducer. The electrothermal transducer is arranged in correspondence with each orifice. A pulse voltage is applied to a corresponding electrothermal transducer in accordance with the print signal to discharge ink from a corresponding orifice.

<Control Arrangement of Inkjet Printing Apparatus (FIG. 2)>

Figure 2:
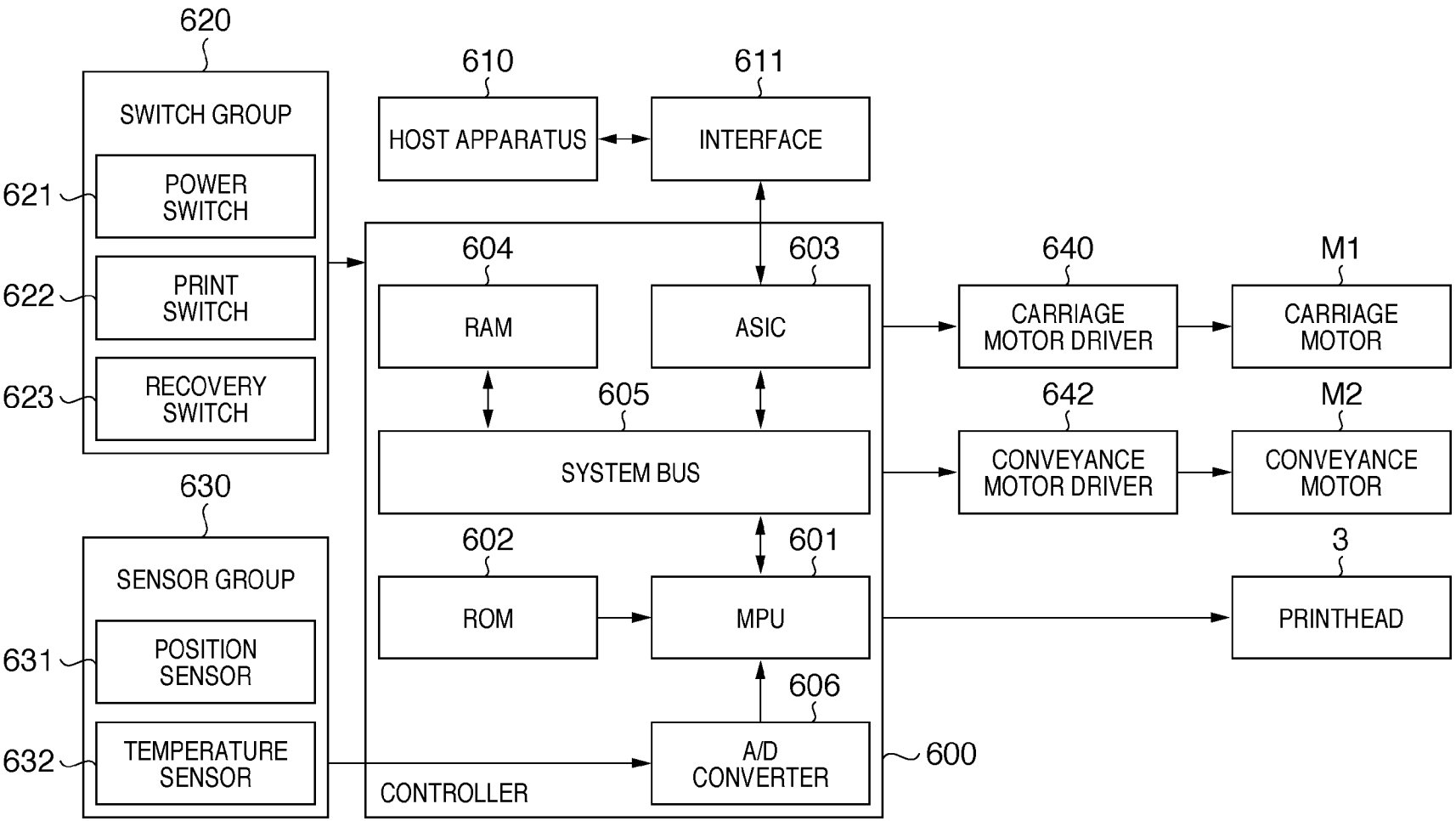
FIG. 2 is a block diagram showing the arrangement of the control circuit of the printing apparatus.

FIG. 2 is a block diagram showing the control arrangement of the printing apparatus shown in FIG. 1.

As shown in FIG. 2, a controller 600 includes a MPU 601, ROM 602, application specific integrated circuit (ASIC) 603, RAM 604, system bus 605, A/D converter 606, and the like. The ROM 602 stores a program corresponding to a control sequence, a predetermined table, and other permanent data. The ASIC 603 generates control signals for controlling a carriage motor M1, a conveyance motor M2, and the printhead 3. The RAM 604 is used as an image data rasterization area, a work area for executing a program, and the like. The system bus 605 connects the MPU 601, ASIC 603, and RAM 604 to each other and allows exchanging data. The A/D converter 606 receives analog signals from sensors (to be described later), A/D-converts them, and supplies the digital signals to the MPU 601.

In FIG. 2, a host apparatus 610 is a computer (or an image reader or digital camera) serving as an image data source. The host apparatus 610 and printing apparatus 1 transmit/receive image data, commands, status signals, and the like via an interface (I/F) 611. The image data is input in, for example, the raster format.

A switch group 620 includes a power switch 621, print switch 622, and recovery switch 623.

A sensor group 630 for detecting an apparatus state includes a position sensor 631 and temperature sensor 632.

A carriage motor driver 640 drives the carriage motor M1 for reciprocating the carriage 2 in directions indicated by the arrow A. A conveyance motor driver 642 drives the conveyance motor M2 for conveying the print medium P.

In print scanning by the printhead 3, the ASIC 603 transfers data to the printhead to drive a printing element (discharge heater) while directly accessing the memory area of the RAM 604.

The ink cartridge 6 and printhead 3 are detachable from each other in the structure shown in FIG. 1, but may also be integrated into a replaceable head cartridge.

Figure 3:
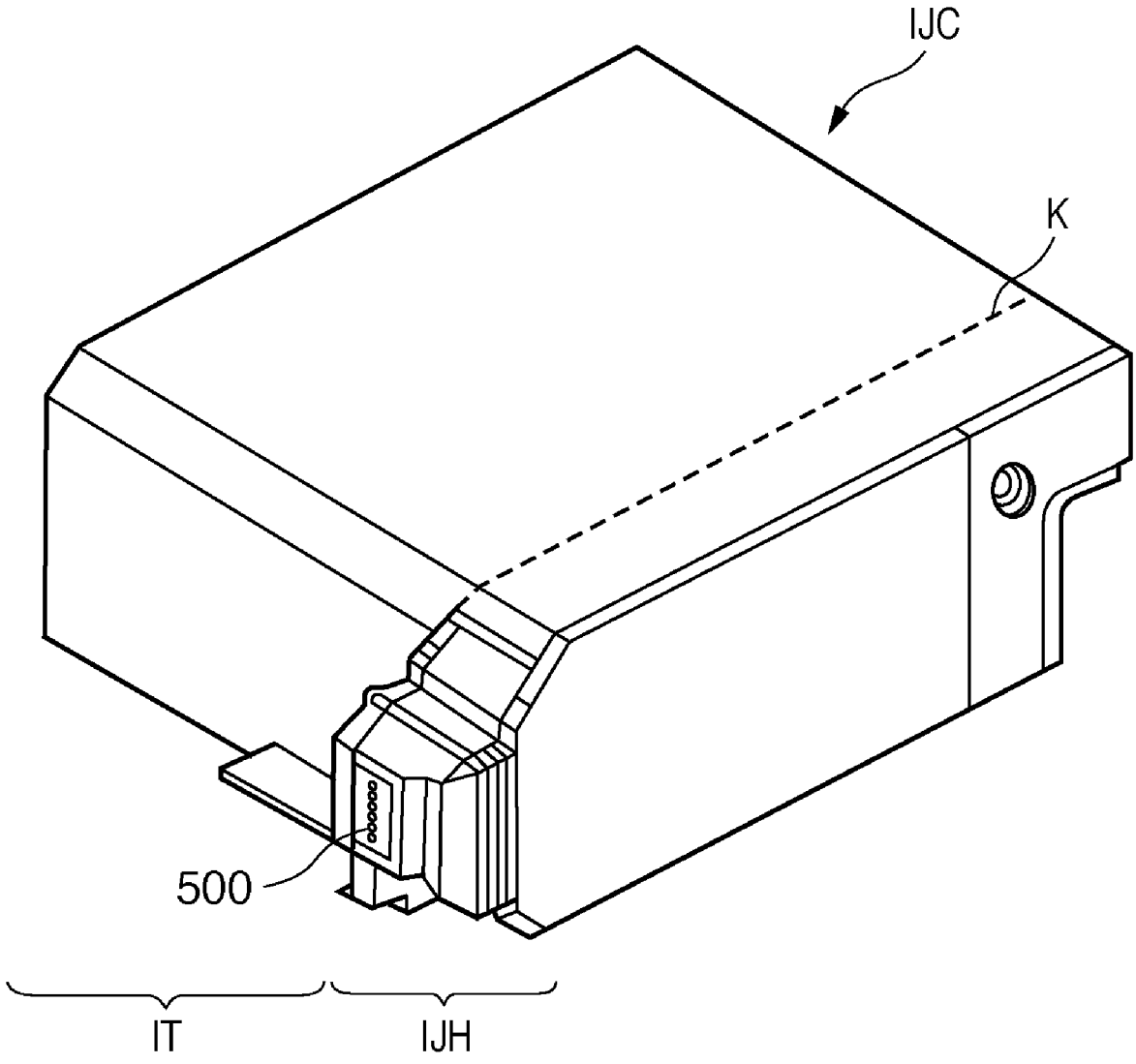
FIG. 3 is a perspective view showing the outer appearance of the structure of a head cartridge IJC which integrates an ink tank and printhead.

FIG. 3 is a perspective view showing the outer appearance of the structure of a head cartridge IJC which integrates the ink tank and printhead. In FIG. 3, a dotted line K indicates the boundary between an ink tank IT and a printhead IJH. The head cartridge IJC has an electrode (not shown) to receive an electrical signal supplied from the carriage 2 when the head cartridge IJC is mounted on the carriage 2. The electrical signal drives the printhead IJH to discharge ink, as described above.

In FIG. 3, reference numeral 500 denotes an ink orifice array.

Several embodiments of a head substrate used in the printing apparatus and printhead having the above-described arrangement will be described.

First Embodiment

Figure 4:
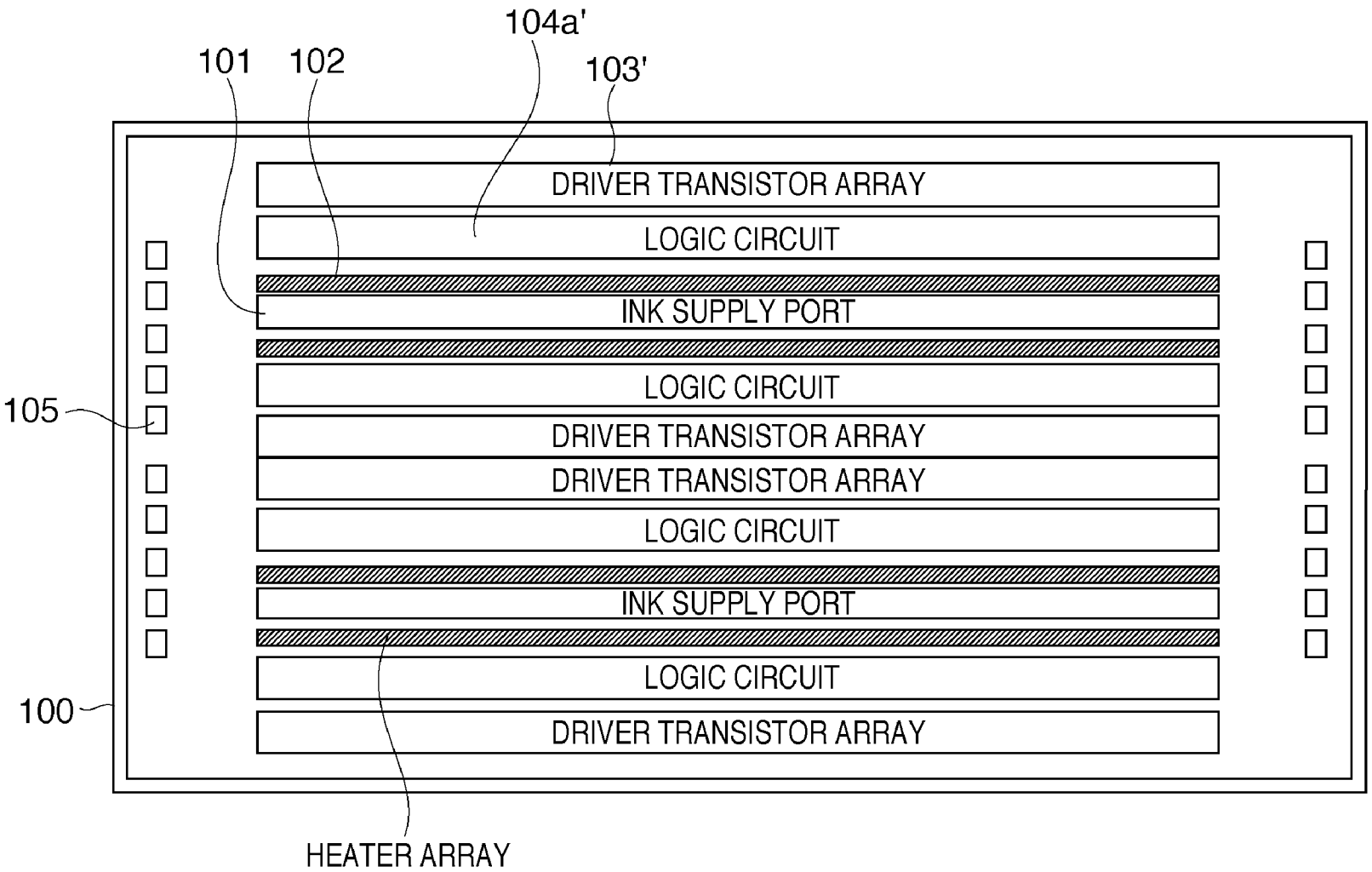
FIG. 4 is a block diagram showing the layout of a head substrate according to the first embodiment of the present invention.

FIG. 4 is a block diagram showing the layout of a head substrate according to the first embodiment of the present invention.

In FIG. 4, the same reference numerals as those described above denote the same parts, and a description thereof will not be repeated. In FIG. 4, reference numeral 103' denotes a transistor array; **104*a*'**, a logic circuit.

Figure 5:
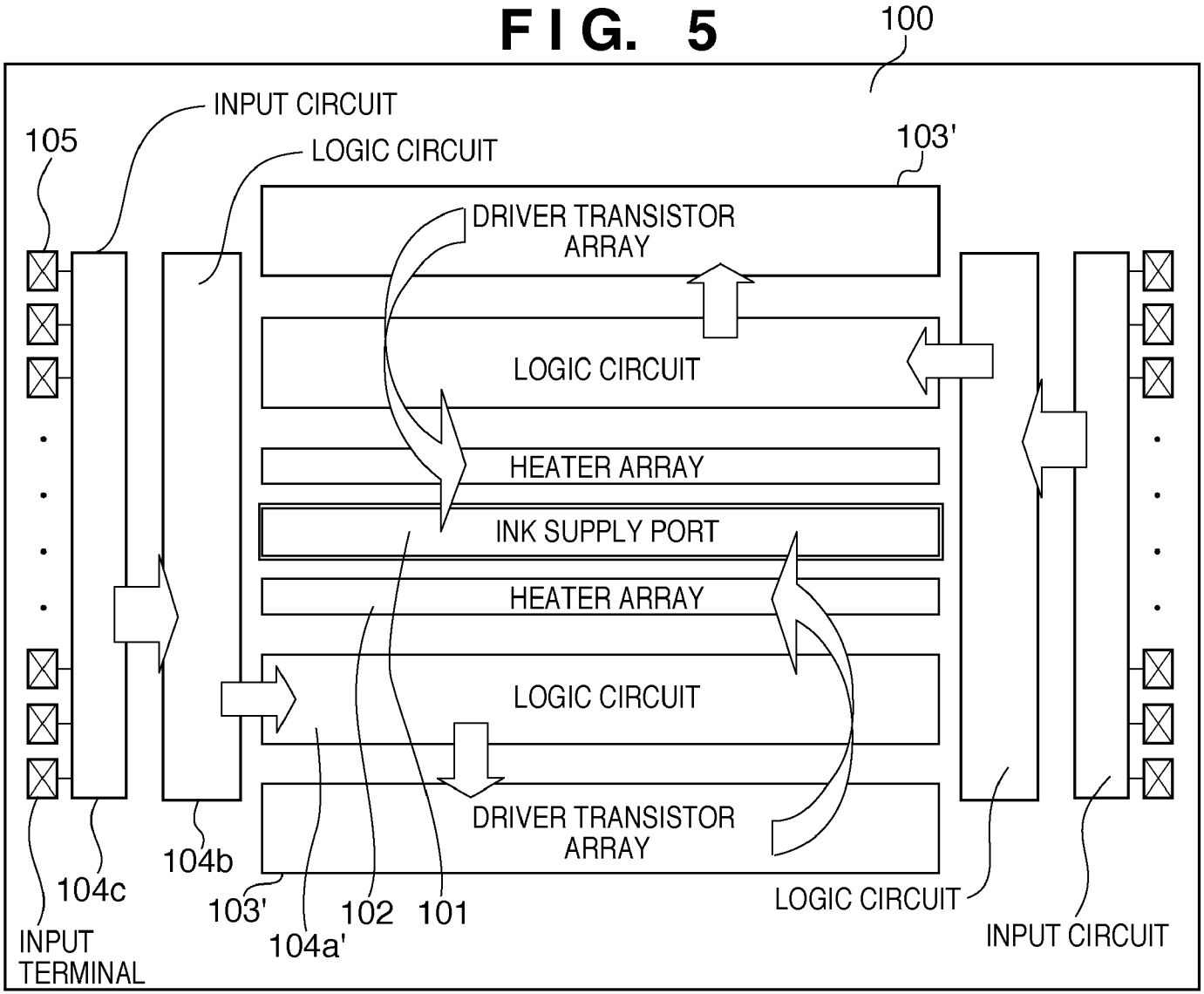
FIG. 5 is a block diagram for explaining a series of operations until the heater is driven after inputting print data to the head substrate.

FIG. 5 is a block diagram for explaining a series of operations until the heater is driven after inputting print data to the head substrate. In FIG. 5, the signal flow is schematically indicated by arrows. FIG. 5 shows a circuit block corresponding to one ink supply port.

Figure 10:
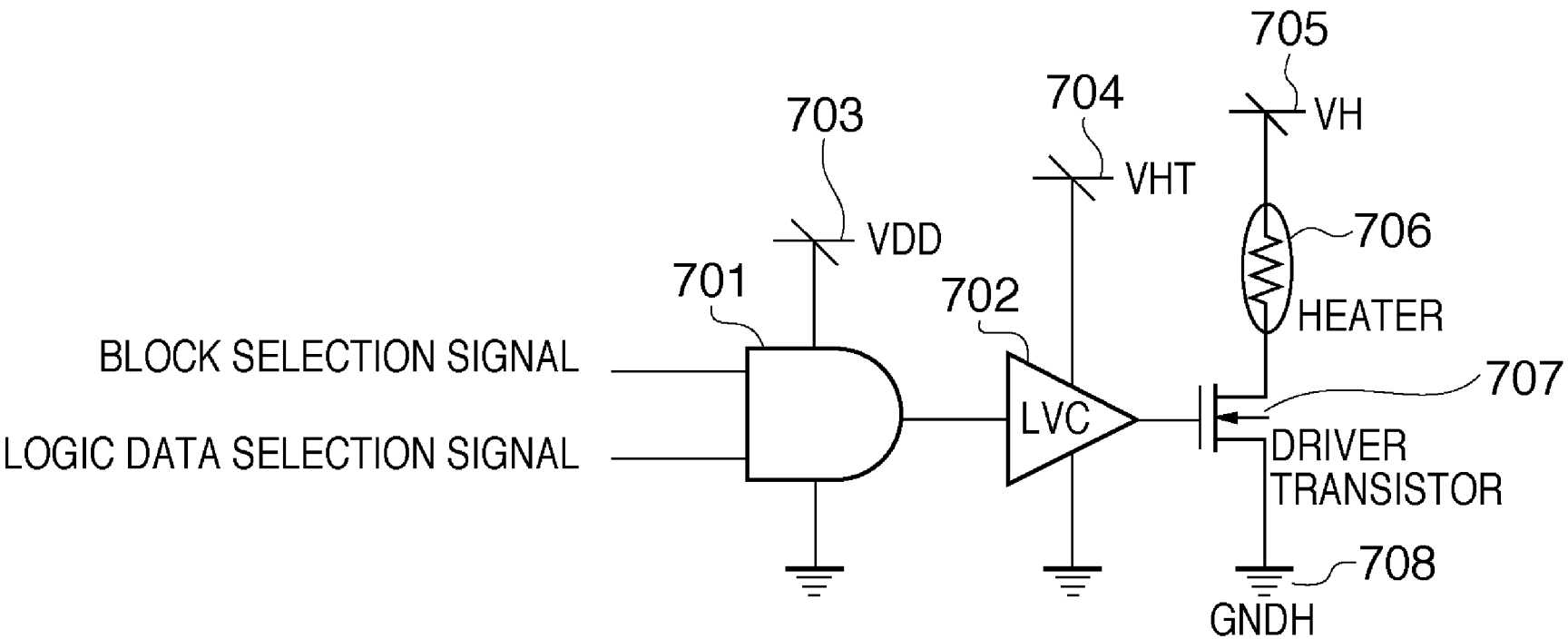
FIG. 10 is an equivalent circuit diagram of one segment for supplying a current to a heater in order to discharge ink.
Figure 11:
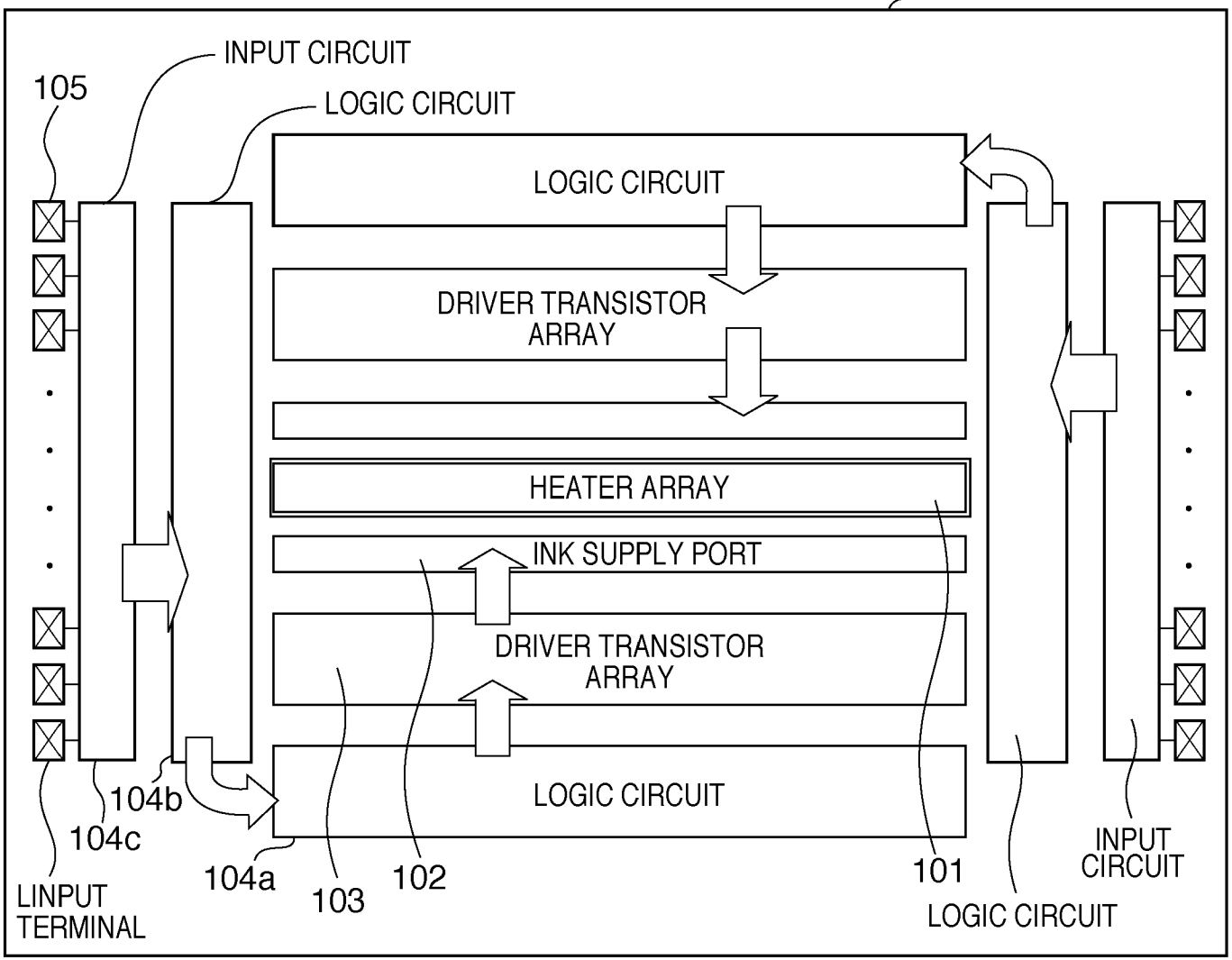
FIG. 11 is a block diagram for explaining a series of operations until the heater is driven after inputting print data to the head substrate.

In FIG. 5, the same reference numerals as those described above denote the same parts, and a description thereof will not be repeated. In FIG. 5, reference numeral **104*a*' denotes a logic circuit including an AND circuit and voltage conversion circuit referred to with reference to FIG. 10**.

Figure 6:
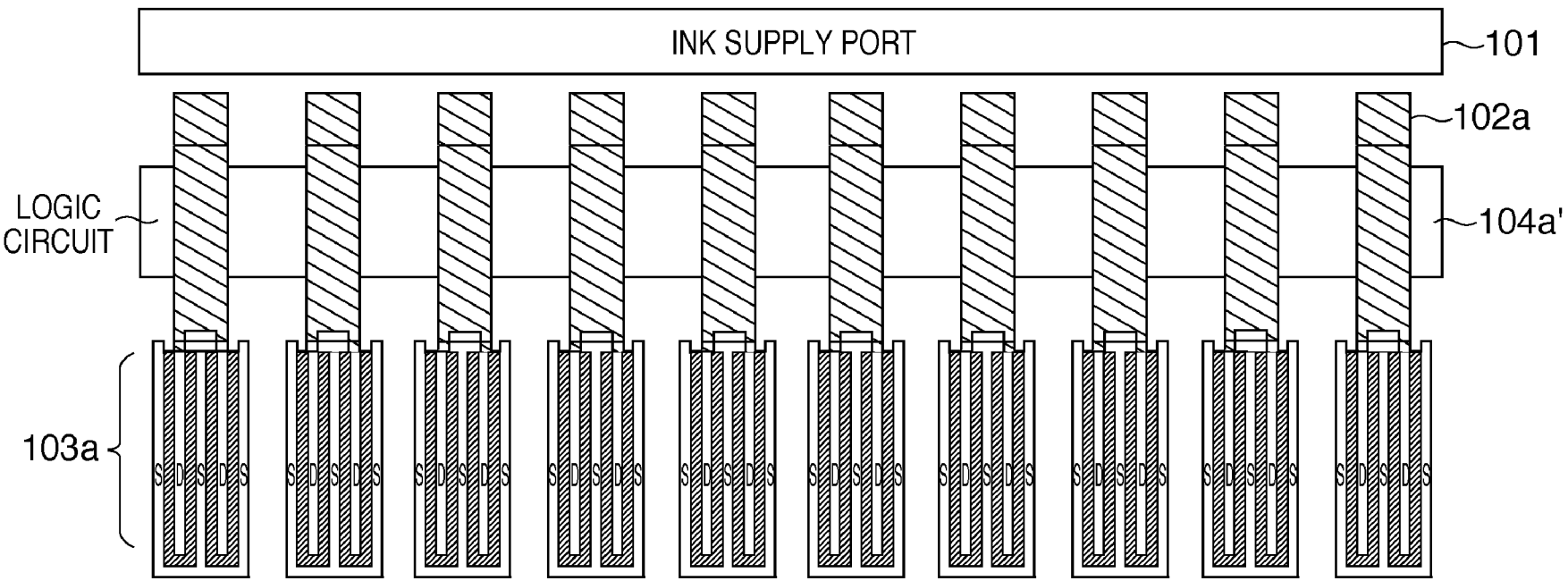
FIG. 6 is a plan view showing the layout of the head substrate shown in FIG. 4.

FIG. 6 is a plan view showing the layout of the head substrate shown in FIG. 4.

In FIG. 6, the same reference numerals as those described above denote the same parts.

Figure 9:
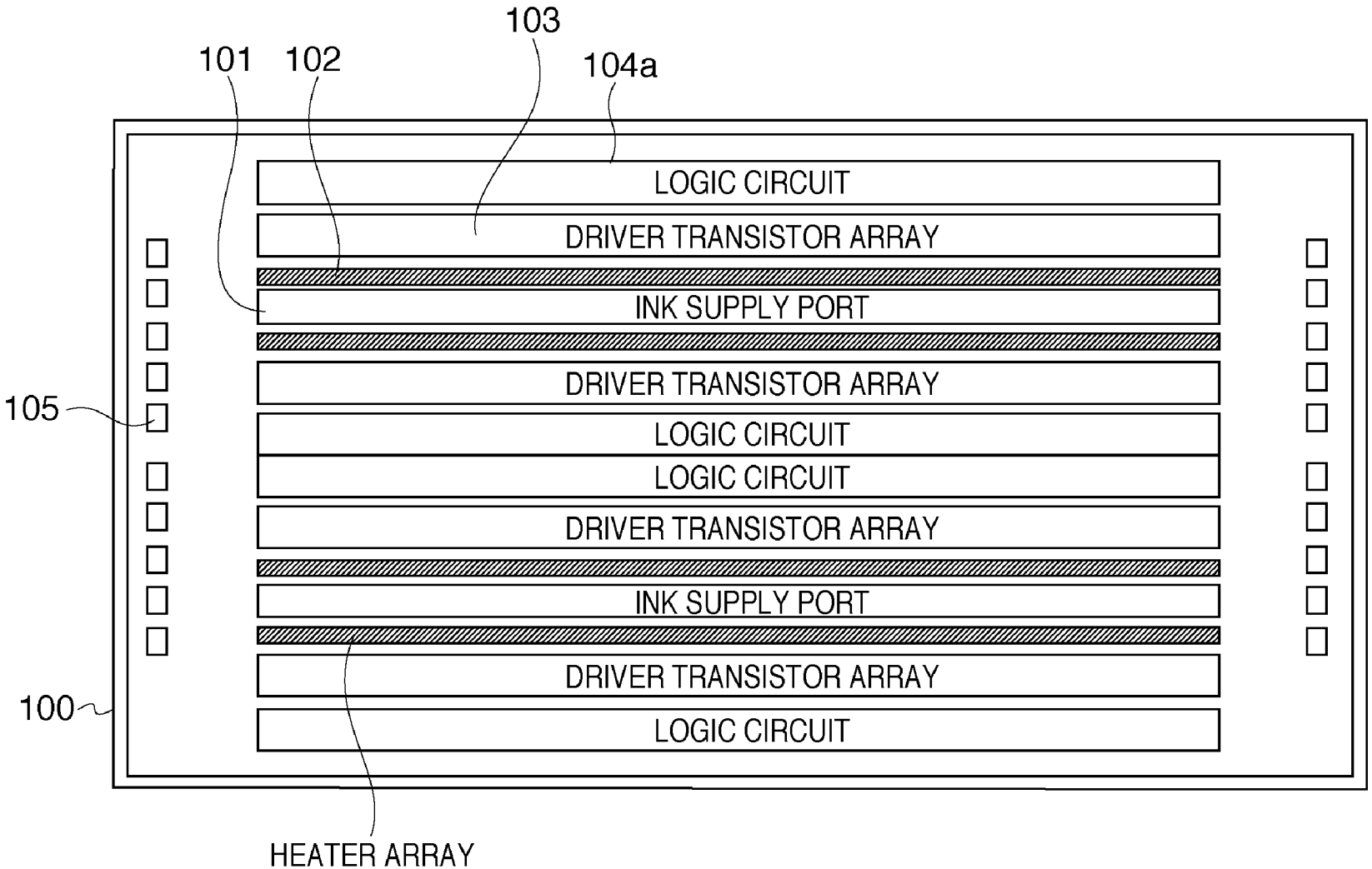
FIG. 9 is a block diagram showing an example of the schematic layout of a head substrate used in a conventional inkjet printhead.
Figure 12:
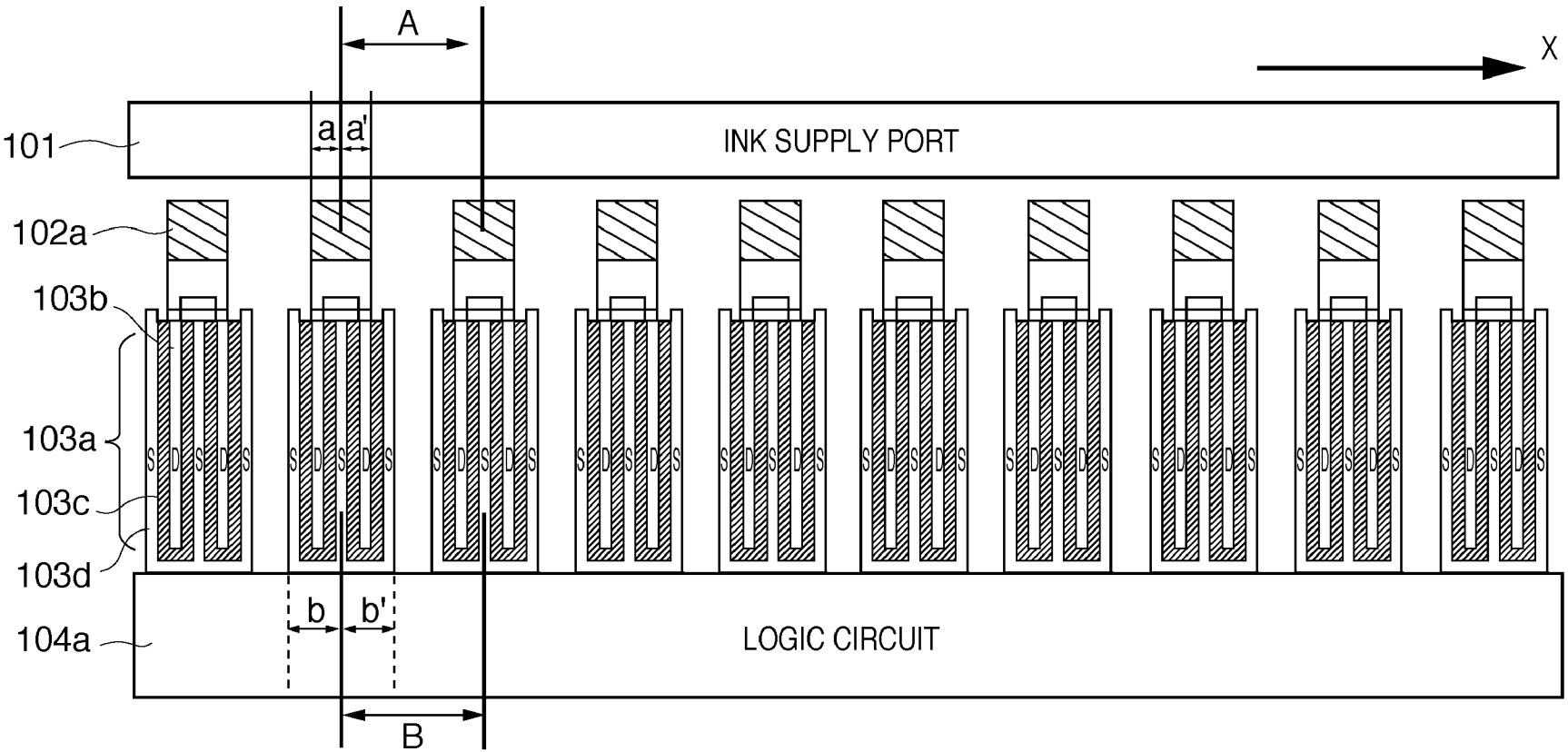
FIG. 12 is a plan view showing the layout of the head substrate shown in FIG. 9.
Figure 13:
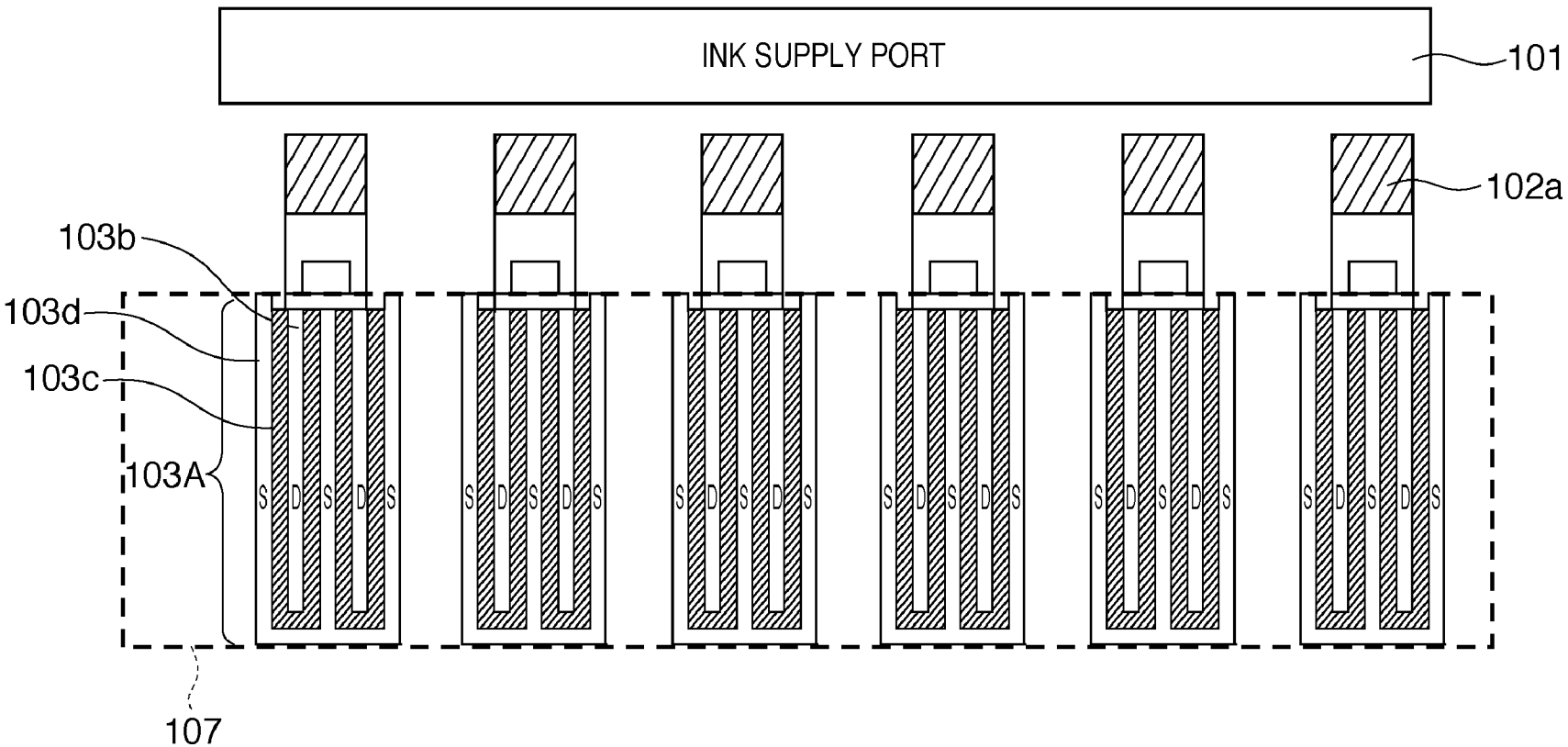
FIG. 13 is a plan view showing part of the layout of a head substrate having a nozzle resolution of 600 dpi.
Figure 14:
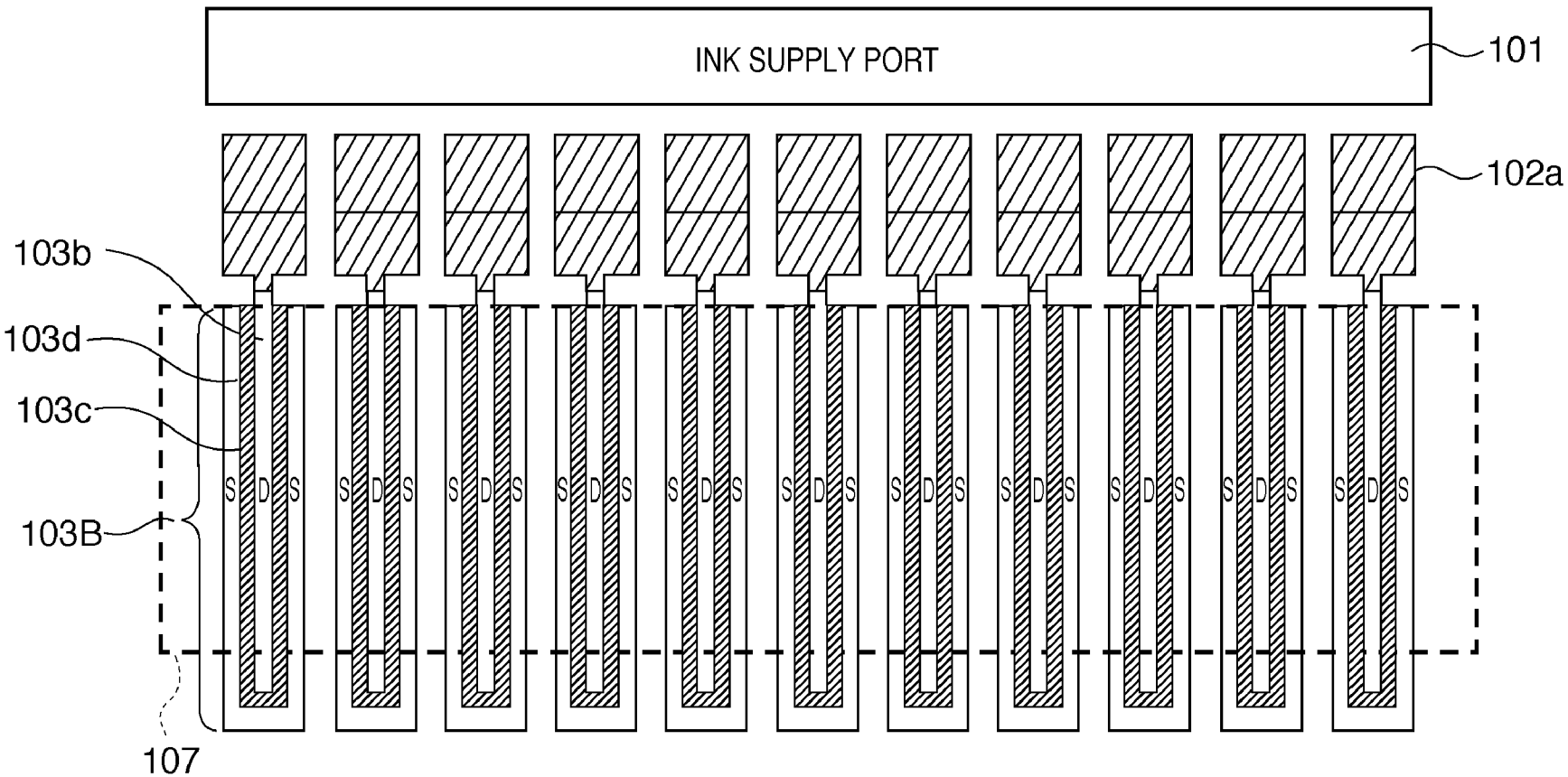
FIG. 14 is a plan view showing part of the layout of a head substrate having a nozzle resolution of 1,200 dpi.

A feature of the first embodiment is that the logic circuit and driver transistor array are interchanged, as is apparent from a comparison between FIG. 9 showing the prior art and FIG. 12. Upon the interchange, the logic circuit is arranged at a position near the heater array where the driver transistor array has been arranged in the conventional arrangement.

As the temperature rises, the driver transistor increases the ON resistance, and a heater current for driving a heater decreases, which may influence the discharge characteristic. The logic circuit suffices to determine the logic by the threshold in order to perform digital signal processing by an AND circuit and voltage conversion circuit. Hence, the influence of the temperature hardly appears in the heater driving characteristic, unlike the driver transistor, and no error particularly occurs in the circuit operation. For this reason, the logic circuit which hardly exhibits the influence of the temperature is arranged adjacent to the heater array, and the driver transistor array is arranged adjacent to the logic circuit.

According to the first embodiment, as shown in FIG. 5, wiring is laid out longitudinally from the driver transistor array to the heater array over the logic circuit. As is apparent from the layout shown in FIG. 6, the logic circuit 104*a*' is arranged between a heater array 102 and the driver transistor array 103', and can maintain a certain distance between the heater array and the driver transistor array. Thus, the influence of heat generated by the heater on the driver transistor can be suppressed.

The above-described embodiment increases the distance between the driver transistor array which may influence the discharge characteristic under the influence of heat, and the heater array, reducing the influence of heat of the heater on the driver transistor. When the nozzle pitch is as small as 600 dpi, the influence on the discharge characteristic can be reduced without changing the gate width W from the conventional one.

Second Embodiment

Figure 15:
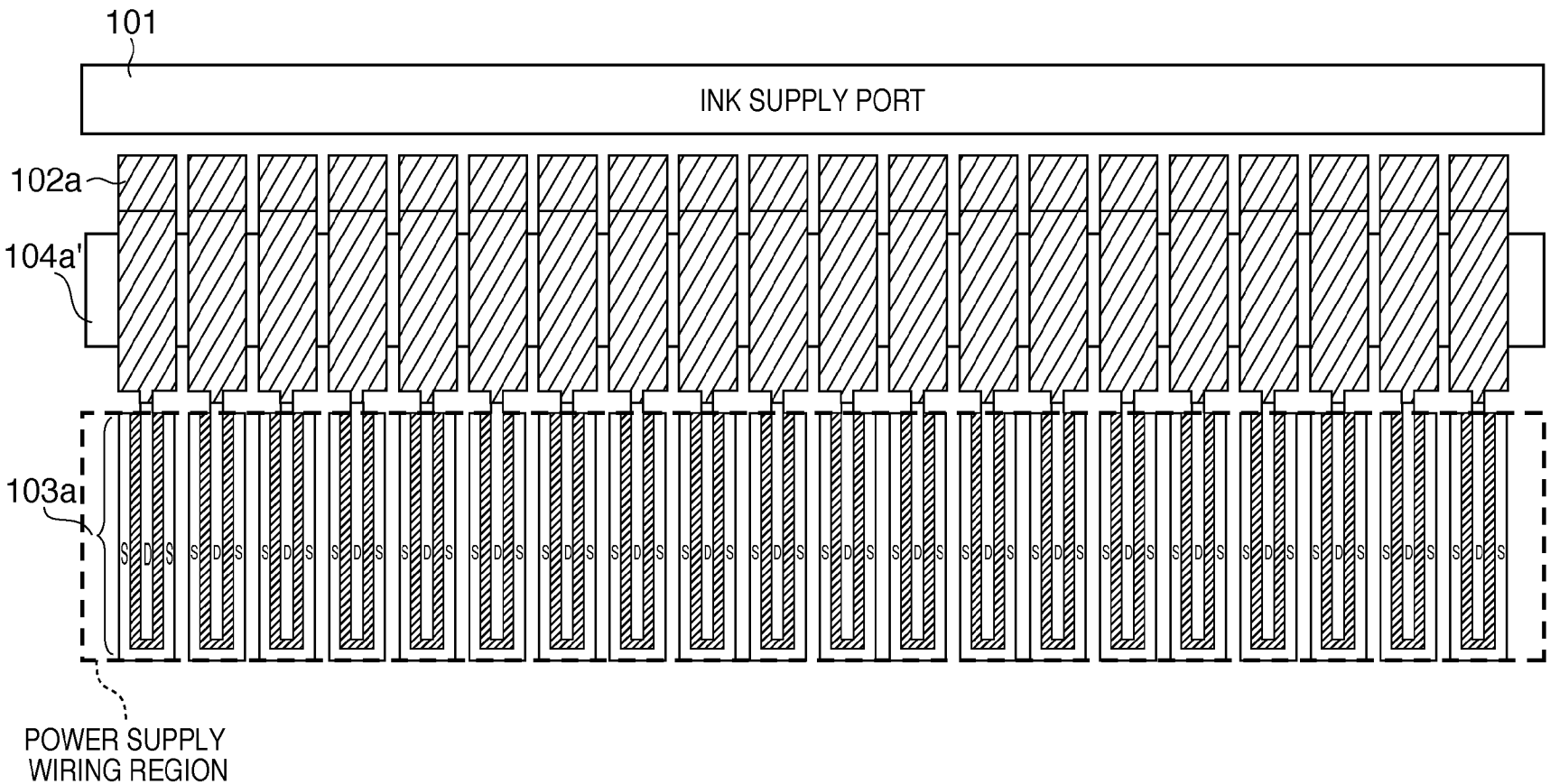
FIG. 15 is a plan view of a layout for explaining the second embodiment of the present invention.

FIG. 15 is a plan view of a layout for explaining the second embodiment of the present invention.

In FIG. 15, the same reference numerals as those shown in FIG. 6 denote the same parts. In this arrangement, a driver transistor 103*a* and logic circuit 104*a*' are interchanged, as described in the first embodiment. In addition, heaters are arranged at double the density in FIG. 6.

In the conventional arrangement, when the nozzle density increases to about 1,200 dpi which is double the density of 600 dpi, the number of gates per nozzle decreases to two at 1,200 dpi though four driver transistor gates can be arranged per nozzle at 600 dpi. Only driver transistors having half the gate width W at 600 dpi can be formed in a transistor region of the same area. As a result, driver transistors cannot be designed with a margin for the gate width W, and a change of the ON resistance under the influence of heat generated by the heater may influence the discharge characteristic. When driver transistors are designed with a margin enough to sufficiently reduce a change of the ON resistance of the driver transistor even under the influence of heat generated by the heater, the gate width increases.

To reduce the influence of generated heat on the head substrate size upon increasing the driver transistor arrangement region, the driver transistor 103*a* and logic circuit 104*a*' are interchanged in the second embodiment, as shown in FIG. 15. Since the heat-sensitive driver transistor 103*a* is spaced apart from a heater 102*a*, the influence of heat on the driver transistor 103*a* is reduced. Hence, the influence of heat can be suppressed even with a small margin of the gate width W of the transistor. Even if the nozzle pitch is decreased to increase the nozzle density, and the number of gates is decreased, an increase in substrate size upon increasing the driver transistor width can be suppressed.

The above-described embodiment increases the distance between the driver transistor array which may influence the discharge characteristic under the influence of heat, and the heater array. The embodiment can reduce the influence of heat of the heater on the driver transistor, and also reduce the influence on the discharge characteristic.

Third Embodiment

Figure 7:
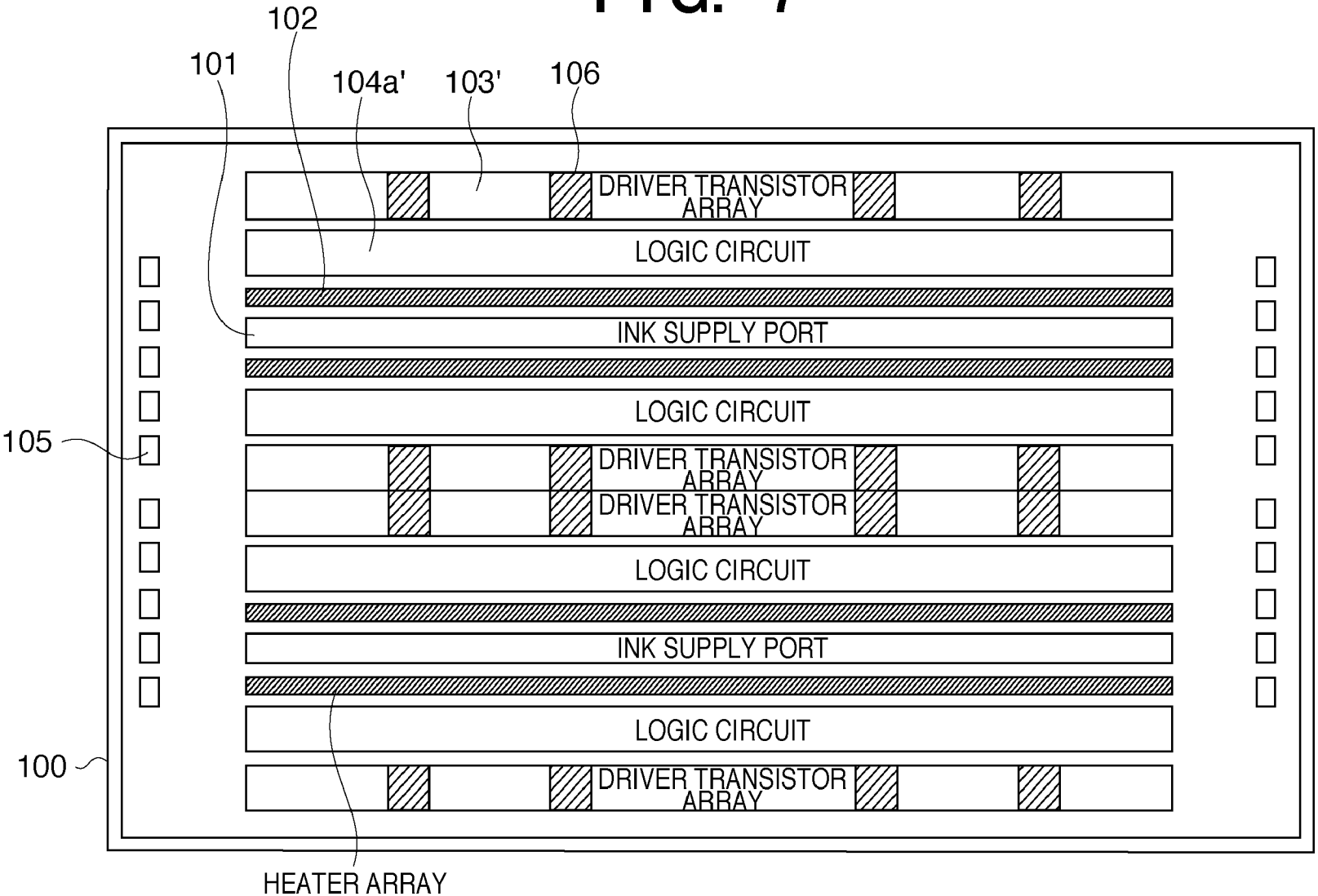
FIG. 7 is a block diagram showing the layout of a head substrate according to the third embodiment of the present invention.

FIG. 7 is a block diagram showing the layout of a head substrate according to the third embodiment of the present invention.

In FIG. 7, the same reference numerals as those described above denote the same parts, and a description thereof will not be repeated. In FIG. 7, reference numeral 106 denotes an empty space.

In addition to the arrangement in the first embodiment, a feature of the third embodiment is that driver transistors are arranged at a pitch smaller than the heater pitch to newly create the empty spaces 106 hatched in FIG. 7.

Figure 8:
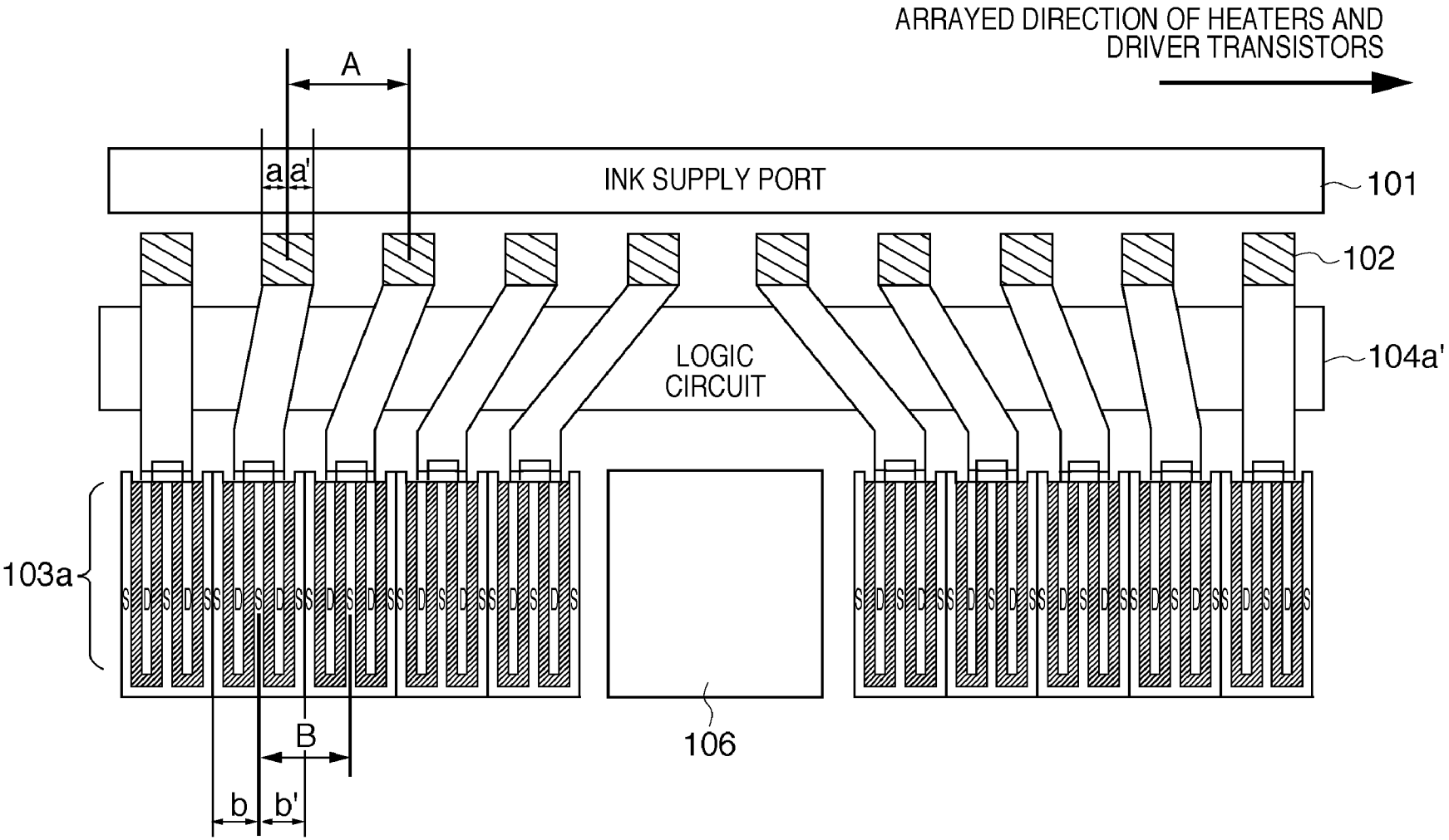
FIG. 8 is a plan view showing the layout of the head substrate shown in FIG. 7.

FIG. 8 is a plan view showing the layout of the head substrate shown in FIG. 7.

In FIG. 8, the same reference numerals as those described above denote the same parts.

In the conventional arrangement, if the heater pitch and driver transistor pitch are set different from each other, like the third embodiment, a predetermined distance needs to be set to lay out diagonal wiring in order to connect heaters and driver transistors. For this reason, a region for only diagonal wiring needs to be ensured.

In the third embodiment, as is apparent from FIG. 8, the driver transistor array and logic circuit are interchanged, and the logic circuit is arranged on a lower layer below the diagonal wiring region. As a result, diagonal wiring can be laid out without increasing the head substrate size and any restriction on the wiring rule. In the arrayed direction (X) of the heaters and driver transistors shown in FIG. 8, the driver transistor pitch (B) is set to be smaller than the heater pitch (A), that is, A>B. This arrangement allows to create a new space in the arrayed direction (X) of the driver transistor array, that is, the nozzle array direction.

In the third embodiment, the empty space 106 is created in the arrayed direction of the driver transistor array, that is, the nozzle array direction. This space can be used to arrange a temperature sensor for monitoring the temperature of the head substrate, an energy adjustment circuit for achieving stable driving, an electrode for an external electrical connection, and the like.

Thus, even if the temperature sensor, energy adjustment circuit, electrode, and the like are arranged, the head substrate size does not increase.

The temperature sensors arranged in the nozzle array direction can detect the temperature distribution in the nozzle array direction.

In a case where the energy adjustment circuit is arranged in the empty space 106, a space for arranging the energy adjustment circuit at the end of the head substrate need not be ensured, and the end of the head substrate and the heater block need not be connected by power supply wiring. This contributes to decreasing the number of wires and downsizing the wiring region on the head substrate. Even if the number of nozzles increases, an increase in substrate size can be suppressed.

In a case where electrodes for an external electrical connection are arranged in the empty space 106, the power supply wiring can be suppressed to a predetermined length regardless of the length of the head substrate in the longitudinal direction by supplying power from each electrode to only neighboring heaters. This prevents an increase in parasitic wire resistance from the electrode to the heater, and reduces power loss.

It is also possible to provide a through-hole electrode, in the empty space 106, through which an electrode for an electrical connection to external power supply is arranged on the lower surface of the head substrate. In the arrangement of the third embodiment, the empty space 106 where the through-hole electrode is arranged exists at a position most distant from an ink supply port 101. Thus, the through-hole electrode hardly contacts ink, increasing reliability. Even on a head substrate with a long nozzle array, high-precision driving control and the like can be performed while suppressing an increase in head substrate size. Further, the layout efficiency of the entire head substrate can increase to suppress the cost of the head substrate.

The above-described embodiment can achieve functional improvement of the printhead and optimization of driving, and the like with an efficient layout.

In addition, the form of the inkjet printing apparatus according to the present invention may also be the form of an image output apparatus for an information processing apparatus such as a computer, the form of a copying machine combined with a reader, or the form of a facsimile apparatus having transmission and reception functions.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-002611, filed Jan. 9, 2008, which is hereby incorporated by reference herein in its entirety.

What is claimed is:

1. A head substrate comprising:

an ink supply port;

a heater array which is arrayed along a longitudinal direction of the ink supply port and includes a plurality of heaters;

a transistor array which is arrayed along an arrayed direction of said heater array and includes a plurality of transistors for driving the plurality of heaters; and a logic circuit which drives said transistor array, wherein said logic circuit is arranged between said heater array and said transistor array, a pitch of the plurality of heaters with respect to a direction in which each of the plurality of heaters is arranged differs from a pitch at which the plurality of transistors is arranged, and the pitch at which the plurality of transistors is arranged is set smaller than the pitch at which the plurality of heaters is arranged, forming an empty space in the arrayed direction of said transistor array.

2. The head substrate according to claim 1, wherein the head substrate has a multi-layer structure, wiring which connects the plurality of transistors and the plurality of heaters is diagonal wiring, and said logic circuit is arranged on a lower layer below the diagonal wiring.

3. The head substrate according to claim 1, wherein a temperature sensor which monitors a temperature of the head substrate is arranged in the empty space.

4. The head substrate according to claim 1, wherein an energy adjustment circuit for achieving stable driving is arranged in the empty space.

5. The head substrate according to claim 1, wherein an electrode for an external electrical connection is arranged in the empty space.

6. A printhead using a head substrate according to claim 1.

7. A head cartridge using a printhead according to claim 6 and an ink tank containing ink to be supplied to the printhead.

8. A printing apparatus using a printhead according to claim 6.

* * * * *